US007800302B2

(12) United States Patent
Choi et al.

(10) Patent No.: US 7,800,302 B2
(45) Date of Patent: Sep. 21, 2010

(54) ELECTROLUMINESCENT ELEMENT AND ELECTRONIC DEVICE INCLUDING THE SAME

(75) Inventors: Byoung Lyong Choi, Seoul (KR); Kyung Sang Cho, Gwachcon-si (KR); Soon Jae Kwon, Seongnam-si (KR); Eun Kyung Lee, Suwon-si (KR); Jae Ho Lee, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 880 days.

(21) Appl. No.: 11/442,875

(22) Filed: May 30, 2006

(65) Prior Publication Data

US 2007/0241662 A1 Oct. 18, 2007

(30) Foreign Application Priority Data

Apr. 13, 2006 (KR) ..... 10-2006-0033549

(51) Int. Cl.
*H05B 33/14* (2006.01)

(52) U.S. Cl. ..... 313/509; 313/503

(58) Field of Classification Search ..... 313/509, 313/506, 503

See application file for complete search history.

(56) References Cited

U.S. PATENT DOCUMENTS

| | | | | |
|---|---|---|---|---|
| 2,993,001 | A | 7/1961 | Shonebarger | |
| 4,741,976 | A * | 5/1988 | Eguchi et al. | 428/690 |
| 6,139,626 | A | 10/2000 | Norris et al. | 117/68 |
| 6,229,259 | B1 * | 5/2001 | Christensen, Sr. | 313/498 |
| 6,525,461 | B1 | 2/2003 | Iwasaki et al. | 313/495 |
| 2003/0127660 | A1 | 7/2003 | Bawendi et al. | |
| 2004/0128882 | A1 * | 7/2004 | Glass | 40/544 |
| 2004/0227705 | A1 * | 11/2004 | Fujimoto et al. | 345/76 |
| 2005/0040366 | A1 | 2/2005 | Yagi et al. | |
| 2005/0174037 | A1 * | 8/2005 | Ueno et al. | 313/486 |
| 2007/0252132 | A1 * | 11/2007 | Kamins et al. | 257/13 |

FOREIGN PATENT DOCUMENTS

EP 1626445 2/2006

OTHER PUBLICATIONS

European Search Report for application No. 07250519.1-1218/1845756 dated Jul. 22, 2009.

* cited by examiner

*Primary Examiner*—Karabi Guharay
(74) *Attorney, Agent, or Firm*—Cantor Colburn LLP

(57) ABSTRACT

An electroluminescent element and an electronic device including the electroluminescent element include a glass template having a silica layer as a matrix, electrodes and a luminescent material. Since the electroluminescent element according to the present invention includes silica as a matrix, the electroluminescent element has a stabilized structure even though a space between the luminescent layer and the electrode of the glass template is not filled. Further, such an electroluminescent element may be easily prepared, and thus may be effectively applied to various electronic devices, such as display devices, illumination devices and backlight units.

28 Claims, 3 Drawing Sheets

ELECTROLUMINESCENT ELEMENT AND ELECTRONIC DEVICE INCLUDING THE SAME

This application claims priority to Korean Patent Application No. 2006-33549, filed on Apr. 13, 2006, and all the benefits accruing therefrom under 35 U.S.C. §119(a), the contents of which in its entirety are herein incorporated by reference.

BACKGROUND OF THE INVENTION

1. Field of the Invention

The present invention relates, generally, to an electroluminescent element and an electronic device including the same, and more particularly, to an electroluminescent element, which comprises a glass template having a silica layer as a matrix, electrodes and a luminescent material, and an electronic device including the electroluminescent element.

2. Description of the Related Art

With the advancement of information and communication technologies in recent years, the demand for optical products having high functionality and high efficiency is increasing tremendously. The development of a luminescent element has progressed rapidly since the 1990s.

The luminescent element may be applied to various optical products, such as displays (e.g., flat panel displays), screens (e.g., computer screens), and medical apparatuses requiring illumination. Thus, high luminance, low operating voltage and high efficiency of the luminescent element are regarded as important factors that determine the quality of these products.

Recently, thorough research into quantum dot displays has been carried out to increase luminous efficiency. The quantum dot display is based on a light emission technique using a tunneling effect through the formation of semiconductor quantum dots having a size of ones of nanometers, in which light emitting diodes being nanometer sized are densely distributed to emit light therefrom, resulting in drastically improved luminous efficiency. However, a considerable part of the light emitted from the luminescent layer is reflected on the surface of the substrate or electrode and is thus captured in the element, undesirably decreasing the amount of emitted light.

Further, research into methods of increasing luminous efficiency using nanowires is being conducted, in which nanowires are linear material having a diameter on the nanometer scale (e.g., 1 nm=$10^{-9}$ m) and a length much greater than the diameter, for example, on hundreds of nanometers, micrometer (e.g., 1 μm=$10^{-6}$ m) or millimeter (e.g., 1 mm=$10^{-3}$ m) scale.

The nanowires may be variously applied to minute devices due to their small size, and are advantageous because they exhibit optical properties of polarization or electron shift in a predetermined direction.

Specifically, the nanowires having electron shift properties may be applied to a nano electronic device such as a multiple single electron transistor ("multi-SET"), and the nanowires having optical properties may be applied to an optical transmission line, a nano anaylzer, or a nano signal sensor used for the diagnosis of cancer, using a surface plasmon polarition mode.

Typically, methods of manufacturing nanowires include, for example, chemical vapor deposition ("CVD"), laser ablation and a template process.

According to the template process, among the above-mentioned processes, pores having a size ranging from ones of nanometers to hundreds of nanometers are formed, and such a pore is used as a nanowire template. For instance, the template process includes oxidizing an aluminum electrode to form aluminum oxide on the surface thereof, electrochemically etching the aluminum oxide to form a template having nanopores, dipping the aluminum electrode into a solution containing metal ions, applying a voltage to stack the metal ions on the aluminum electrode through pores so that the pores are filled with the metal ions, and then removing the oxide using an appropriate process, thus obtaining metal nanowires alone.

With regard to the method of manufacturing nanowires using a template, a method of manufacturing nanowires by forming a catalytic film on a substrate, forming a porous layer on the film, and forming titanium nanowires in pores through heat treatment has been disclosed in U.S. Pat. No. 6,525,461.

In addition, a method of manufacturing a quantum dot solid using a template comprising introducing colloidal nanocrystals into pores formed in the template to form the quantum dot solid through heat treatment, has been disclosed in U.S. Pat. No. 6,139,626.

However, such conventional nanowire-manufacturing methods are disadvantageous because they require a long manufacturing time and thus are unsuitable for mass production. As well, in the case of the electroluminescent element using nanowires, it is difficult to ensure linearity of the grown nanowires, and spaces between the nanowires are filled with another material to form an electrode, leading to a complicated manufacturing process.

BRIEF SUMMARY OF THE INVENTION

Accordingly, the present invention has been made keeping in mind the above problems occurring in the related art, and an aspect of the present invention includes an electroluminescent element comprising a glass template, which has a simple preparation process and a stabilized structure without the need to fill the spaces therein.

Another aspect of the present invention includes an electronic device including the exemplary electroluminescent element described above.

In order to accomplish the above aspects, an exemplary embodiment of the present invention includes an electroluminescent device includes a glass template, which includes a silica layer as a matrix, electrodes and a luminescent material.

In the electroluminescent element of the present invention, the glass template may further include a protective film on an outer layer of the upper electrode, and may further include a substrate.

As such, the substrate may be selected from the group consisting of glass, ITO glass, quartz, a silicon wafer, a silica-applied substrate and an alumina-applied substrate.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
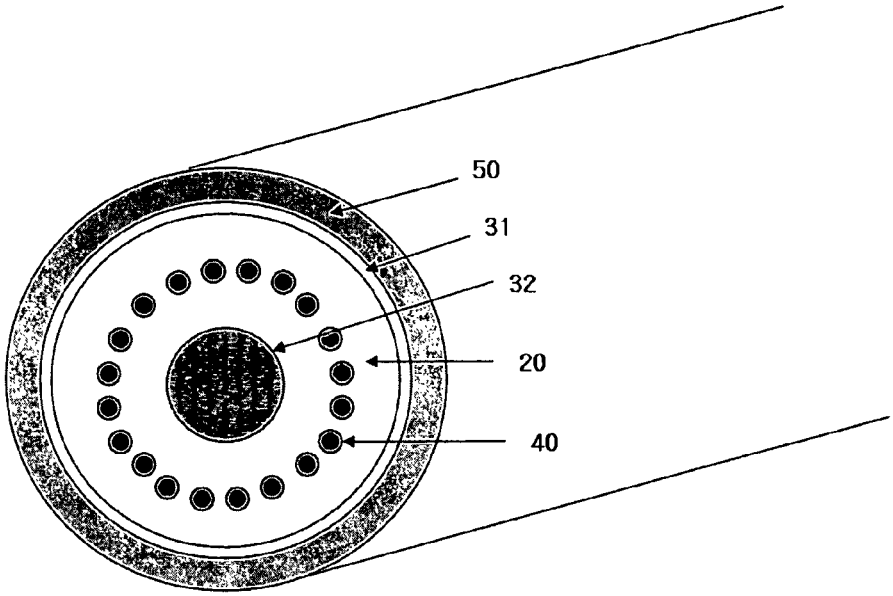
FIG. 1 is a schematic partial cross-sectional perspective view showing an exemplary embodiment of a glass template having a fiber type structure according to the present invention.

The present invention will now be described more fully hereinafter with reference to the accompanying drawings, in which exemplary embodiments of the present invention are shown. This invention may, however, be embodied in many different forms and should not be construed as limited to the exemplary embodiments set forth herein. Rather, these exemplary embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Acting as one constituent of an exemplary embodiment of an electroluminescent element according to the present invention, a glass template may be of various types, such as a fiber type, a tape type or a double-sided luminescence type.

FIG. 1 is a schematic partial cross-sectional perspective view showing an exemplary embodiment of a glass template having a fiber type structure according to the present invention.

As shown in FIG. 1, the exemplary fiber type glass template comprises a silica layer 20, an upper electrode 31 and a lower electrode 32 respectively positioned at an outer portion and an inner portion of the silica layer 20, and a luminescent material 40 in the silica layer 20 interposed between the upper electrode 31 and the lower electrode 32.

The luminescent material 40 is preferably inserted into pores of the glass template at predetermined intervals, but the intervals of the luminescent material 40 are not limited thereto.

In the electroluminescent element of the present invention, the fiber type glass template may further comprise a protective film 50 on an outer layer of the upper electrode 31, in which the protective film 50 functions to protect the glass template from physical impact. Further, the protective film 50 should be transparent to pass light emitted from the fiber therethrough. The protective film 50 may be formed of a transparent polymer, such as tri-acetyl-cellulose (TAC), silicone rubber, or polymethyl methacrylate (PMMA), or inorganic material, such as silica.

Figure 2:
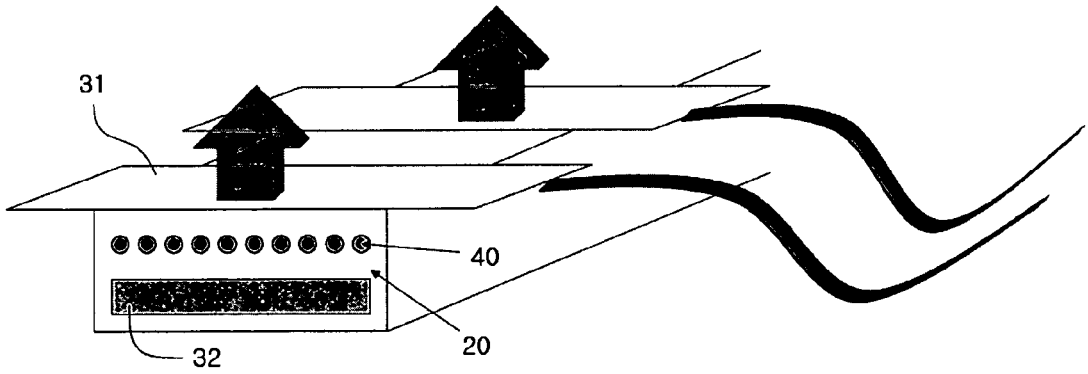
FIG. 2 is a schematic partial cross-sectional perspective view showing another exemplary embodiment of a glass template having a tape type structure according to the present invention.

FIG. 2 is a schematic partial cross-sectional perspective view showing another exemplary embodiment of a glass template having a tape type structure according to the present invention.

As shown in FIG. 2, the exemplary tape type glass template comprises a silica layer 20, an upper electrode 31 and a lower electrode 32 respectively positioned at an upper portion and a lower portion of the silica layer 20, and a luminescent material 40 interposed between the upper electrode 31 and the lower electrode 32.

The luminescent material 40 is preferably inserted into pores of the glass template at predetermined intervals, but the intervals of the luminescent material 40 are not limited thereto.

Figure 3:
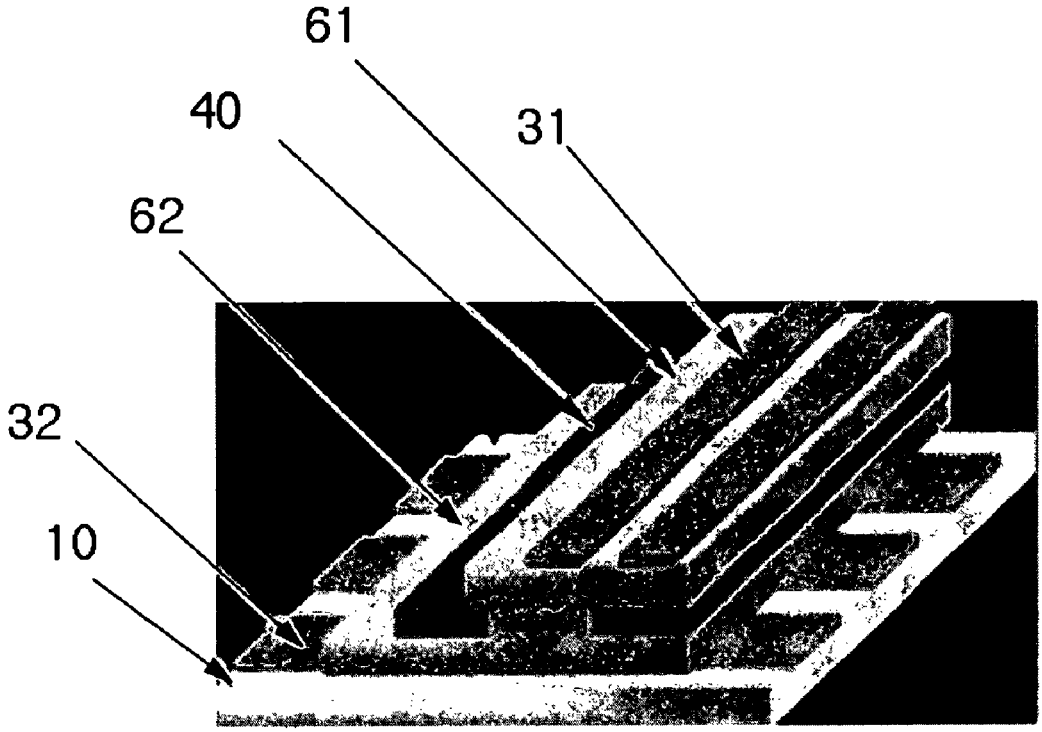
FIG. 3 is a schematic perspective view showing an exemplary embodiment of an electroluminescent element, in which the glass template having a tape type structure is laminated on a substrate, according to the present invention.

In the electroluminescent element of the present exemplary embodiment, the tape type glass template is laminated on a substrate 10 (see FIG. 3). As such, the substrate 10 may be selected from the group consisting of glass, quartz, a silicon wafer, a silica-applied substrate, an alumina-applied substrate, and all materials usable as a substrate. In addition, in the case where ITO glass is used as the substrate, since the ITO glass functions as the lower electrode 32, it is possible to realize a structure without an interposed lower electrode 32 in the silica layer 20, as shown in FIG. 3. Further, when the upper electrode 31 is disposed perpendicular to the tape type glass template, a portion thereof makes a pair with the lower electrode 32 to constitute a light-emitting region, thus forming a pixel of a display device, but the structure of the upper electrode 31 is not limited thereto.

In the electroluminescent element of the present invention, the tape type glass template may further comprise a protective film 50 (Not shown in FIGS. 2 and 3) on an outer layer of the upper electrode 31, in which the protective film 50 functions to protect the glass template from physical impact, as described above with reference to FIG. 1. The protective film 50 may be formed of a transparent polymer, such as tri-acetyl-cellulose (TAC), silicone rubber, or plymethyl methacrylate (PMMA), or inorganic material, such as silica.

FIG. 3 is a schematic perspective view showing another exemplary embodiment of an electroluminescent element, in which the glass template having a tape type structure is laminated on the substrate 10, according to the present invention.

As shown in FIG. 3, the tape type glass template may have a structure in which a lower insulating layer 62 is provided between the lower electrode 32 and the luminescent material 40 of the tape type glass template of FIG. 2 and an upper insulating layer 61 is provided between the luminescent material 40 and the upper electrode 31 thereof.

In an exemplary embodiment, the upper insulating layer 61 and the lower insulating layer 62 need not be formed due to the presence of an insulting layer in the glass template itself, or may be formed into a thin or thick dielectric film, but the present invention is not limited thereto.

As the thin or thick dielectric film, a film formed of a material, such as silica, which is transparent and has a high dielectric constant, may be used.

Figure 4:
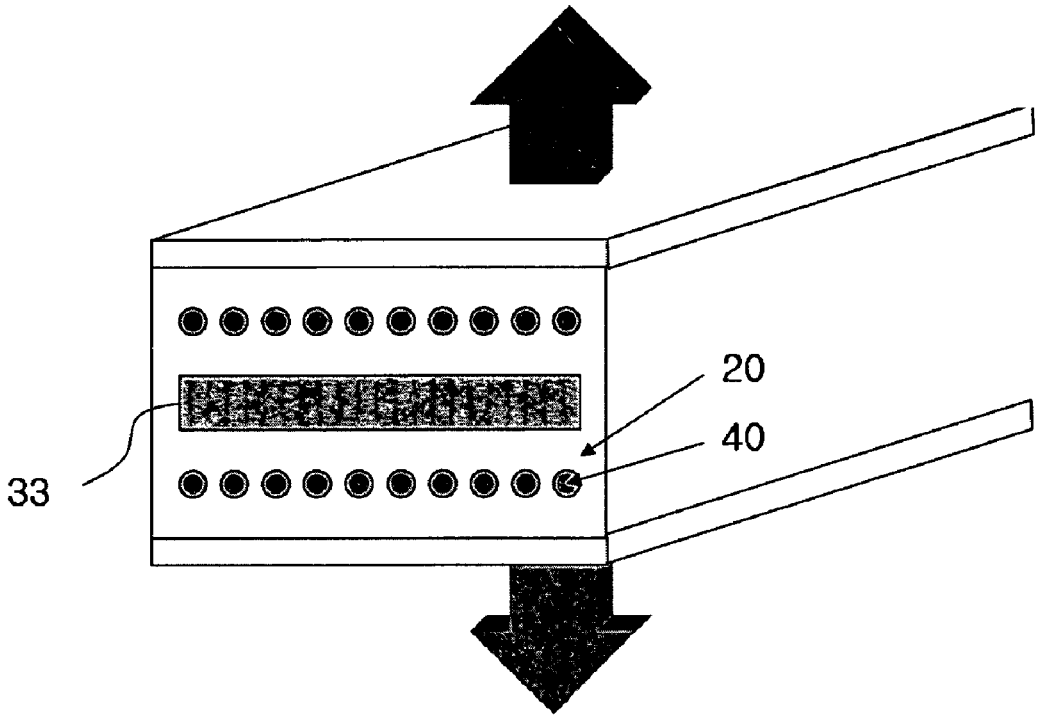
FIG. 4 is a schematic partial cross-sectional perspective view showing a glass template having another exemplary embodiment of a double-sided luminescence type structure according to the present invention.

FIG. 4 is a schematic partial cross-sectional perspective view showing another exemplary embodiment of a glass template having a double-sided luminescence type structure according to the present invention.

As shown in FIG. 4, the exemplary double-sided luminescence type glass template comprises a silica layer 20, a luminescent material 40 disposed at each of an upper portion and a lower portion of the silica layer 20, and a common electrode 33 positioned between the upper and lower luminescent materials 40.

The luminescent material 40 is preferably inserted into pores of the glass template at predetermined intervals, but the intervals of the luminescent material 40 are not limited thereto.

In the electroluminescent element of the present invention, the double-sided luminescence type glass template is laminated on the substrate 10 (see FIG. 3). As such, the substrate 10 may be selected from the group consisting of glass, ITO glass, quartz, a silicon wafer, a silica-applied substrate and an alumina-applied substrate.

In the exemplary embodiment of the electroluminescent element of the present invention, the double-sided luminescence type glass template may further comprise a protective film 50 (not shown in FIG. 4) on upper and lower outside surfaces thereof, in which the protective film 50 functions to protect the glass template from physical impact, as described above with reference to FIG. 1. The protective film 50 may be formed of a transparent polymer, such as tri-acetyl-cellulose (TAC), silicone rubber, or polymethyl methacrylate (PMMA), or inorganic material such as silica.

Silica is silicon dioxide ($SiO_2$) as a component of various silicates that naturally occur. Silica is produced in crystalline form or amorphous form using quartz, crystal, chalcedony, agate, flint, silica sand, tridymite or cristobalite. In particular, quartz is the most abundant mineral after feldspar, is widely distributed on the earth, and constitutes 12% of the soil on the earth.

Although silica for use in the silica layer 20, which is included as a matrix in the glass template of the electroluminescent element of the present invention, is not particularly limited, quartz, tridymite, cristobalite, amorphous glass, or glass having impurities may also be used.

The luminescent material 40 used for the exemplary embodiments of the electroluminescent element of the present invention may be formed of an inorganic phosphor, a quantum dot, or a mixture thereof, but is not limited thereto. The inorganic phosphor and quantum dot can emit green, blue and red light. When the inorganic phosphor having a size of about 1 μm to about 10 μm is mixed with the quantum dot having a size of about 1 μm to about 10 μm, the cavity in the inorganic phosphor is filled with the quantum dot. Thus, even though a thin luminescent material is used, an electroluminescent element having excellent luminous efficiency may be manufactured.

In particular, since green and blue inorganic phosphors can exhibit excellent luminous efficiency alone, only inorganic phosphors need be used. However, in the case of the red inorganic phosphor having very low luminous efficiency at 350~450 nm, a luminescent material comprising a mixture of an inorganic phosphor and a quantum dot should be used in order to increase the luminous efficiency of the red inorganic phosphor.

The inorganic phosphor may be selected from the group consisting of $La_2O_2S$:Eu, $Li_2Mg(MoO_4)$:Eu,Sm, $(Ba,Sr)_2SiO_4$:Eu, ZnS:Cu,Al, $SrGa_2S_4$:Eu, $Sr_5(PO_4)_3Cl$:Eu, $(SrMg)_5PO_4Cl$:Eu, $BaMg_2Al_{16}O_{27}$:Eu, and mixtures thereof, but is not limited thereto.

In addition, the quantum dot may be selected from the group consisting of group II-VI compound semiconductor nanocrystals, such as CdS, CdSe, CdTe, ZnS, ZnSe, ZnTe, HgS, HgSe and HgTe, group III-V compound semiconductor nanocrystals, such as GaN, GaP, GaAs, InP and InAs, and mixtures thereof, but is not limited thereto.

In the exemplary embodiments of the electroluminescent element of the present invention, although the material for the upper electrode 31 is not particularly limited, conductive metal or oxides thereof, such as indium tin oxide (ITO), indium zinc oxide (IZO), nickel (Ni), platinum (Pt), gold (Au), and iridium (Ir), may be used. Further, although material for the lower electrode 32 is not particularly limited, metal having a low work function, that is, Li, Cs, Ba, Ca, Ca/Al, LiF/Ca, LiF/Al, $BaF_2$/Ca, Mg, Ag, Al, or alloys thereof, may be used. In addition, any material suitable for use in the upper electrode 31 may be used.

The exemplary embodiments of the electroluminescent element of the present invention do not require any special apparatus or method for manufacture, and may be manufactured through a typical process of manufacturing a luminescent element using a glass template.

In addition, exemplary embodiments of the present invention provide an electronic device, including the exemplary electroluminescent element having the glass template.

Examples of the electronic device include display devices, illumination devices and backlight units.

A better understanding of the present invention may be obtained through the following examples, which are set forth to illustrate, but are not to be construed as limiting the present invention.

EXAMPLE 1

Preparation of Fiber Type Glass Template

An Al electrode was formed in the core portion of a porous glass template having the structure shown in FIG. 1. Then, IZO was deposited to a thickness of 100 nm on the outer portion of the glass template, thus forming an upper electrode 31.

A luminescent material 40 comprising a mixture of $La_2O_2S$:Eu and CdS was inserted into pores positioned between the upper electrode 31 and the lower electrode 32 at predetermined intervals to form a luminescent layer, after which an outer layer of the upper electrode 31 was coated with tri-acetyl-cellulose (TAC) to form a protective film 50, thereby preparing a fiber type glass template.

EXAMPLE 2

Preparation of Tape Type Glass Template

A tape type glass template having an upper electrode 31 formed of IZO was prepared in the same manner as in Example 1, with the exception that an Al electrode was formed at the lower portion of a glass template having the structure shown in FIG. 2, and ZnS:Cu,Al was used as the luminescent material 40.

EXAMPLE 3

Preparation of Double-Sided Luminescence Type Glass Template

A double-sided luminescence type glass template was prepared in the same manner as in Example 1, with the exception that a common electrode 33 made of Al was formed at the intermediate portion of a glass template having a structure shown in FIG. 4, and a luminescent layer 40 was formed at upper and lower portions of the common electrode.

EXAMPLE 4

Fabrication of Electroluminescent Element

The fiber type glass template prepared in Example 1 was disposed on a glass substrate patterned with ITO, thus completing an electroluminescent element.

EXAMPLE 5

Fabrication of Electroluminescent Element

The tape type glass template prepared in Example 2 was disposed on a glass substrate, thus completing an electroluminescent element.

EXAMPLE 6

Fabrication of Display Device

When the upper electrode 31 was formed in Example 5, a tape type upper electrode was formed perpendicular to the longitudinal direction of the tape type glass template, such that a pair of electrodes 31 could be operated as a unit pixel of a display device to emit light, thereby fabricating a display device equipped with the electroluminescent element.

As described hereinbefore, the present invention provides an electroluminescent element and an electronic device including the same. According to the present invention, since the electroluminescent element includes silica as a matrix, it has a stabilized structure even though a space between the luminescent layer and the electrode of the glass template is not filled. Further, such an electroluminescent element may be easily prepared, and therefore may be effectively applied to various electronic devices, such as display devices, illumination devices and backlight units.

Although the exemplary embodiments of the present invention have been disclosed for illustrative purposes, those skilled in the art will appreciate that various modifications, additions and substitutions are possible, without departing from the scope and spirit of the present invention as disclosed in the accompanying claims.

What is claimed is:

1. An electroluminescent element, the element comprising:
a glass template, which includes a silica matrix and a plurality of pores,
electrodes on opposing sides of the glass template, and
a luminescent material in the plurality of pores,
wherein the luminescent material comprises an inorganic phosphor and a quantum dot.

2. The element as set forth in claim 1, wherein the glass template further comprises a protective film on an outer layer of an upper electrode.

3. The element as set forth in claim 1, wherein the glass template is laminated on a substrate.

4. The element as set forth in claim 3, wherein the substrate is selected from the group consisting of glass, ITO glass, quartz, a silicon wafer, a silica-applied substrate and an alumina-applied substrate.

5. The element as set forth in claim 1, wherein the glass template has any one structure selected from the group consisting of a fiber type, a tape type and a double-sided luminescence type.

6. The element as set forth in claim 5, wherein the fiber type glass template comprises a silica layer, an upper electrode and a lower electrode respectively positioned at an outer portion and an inner portion of the silica layer, and a luminescent material interposed between the upper electrode and the lower electrode.

7. The element as set forth in claim 6, wherein the fiber type glass template further comprises a protective film on an outer layer of the upper electrode.

8. The element as set forth in claim 6, wherein the luminescent material is inserted into pores of the glass template at predetermined intervals.

9. The element as set forth in claim 6, wherein the fiber type glass template is laminated on a substrate.

10. The element as set forth in claim 9, wherein the substrate is selected from the group consisting of glass, ITO glass, quartz, a silicon wafer, a silica-applied substrate and an alumina-applied substrate.

11. The element as set forth in claim 5, wherein the tape type glass template comprises a silica layer, an upper electrode and a lower electrode respectively positioned at an upper portion and a lower portion of the silica layer, and a luminescent material interposed between the upper electrode and the lower electrode.

12. The element as set forth in claim 11, wherein the tape type glass template further comprises a protective film on an outer layer of the upper electrode.

13. The element as set forth in claim 11, wherein the luminescent material is inserted into pores of the glass template at predetermined intervals.

14. The element as set forth in claim 11, wherein the tape type glass template is laminated on a substrate.

15. The element as set forth in claim 14, wherein the substrate is selected from the group consisting of glass, ITO glass, quartz, a silicon wafer, a silica-applied substrate and an alumina-applied substrate.

16. The element as set forth in claim 11, wherein the tape type glass template further comprises a lower insulating layer between the lower electrode and the, luminescent material and an upper insulating layer between the luminescent material and the upper electrode.

17. The element as set forth in claim 16, wherein the upper insulating layer and the lower insulating layer are each a thin or thick dielectric film.

18. The element as set forth in claim 5, wherein the double-sided luminescence type glass template comprises a silica layer, a luminescent material disposed at each of an upper portion and a lower portion of the silica layer, and a common electrode positioned between upper and lower luminescent materials.

19. The element as set forth in claim 18, wherein the double-sided luminescence type glass template further comprises a protective film on exposed upper and lower surfaces thereof.

20. The element as set forth in claim 18, wherein the luminescent material is inserted into pores of the glass template at predetermined intervals.

21. The element as set forth in claim 18, wherein the double-sided luminescence type glass template is laminated on a substrate.

22. The element as set forth in claim 21, wherein the substrate is selected from the group consisting of glass, ITO glass, quartz, a silicon wafer, a silica-applied substrate and an alumina-applied substrate.

23. The element as set forth in claim 1, wherein the quantum dot is in a cavity of the inorganic phosphor.

24. The element as set forth in claim 1, wherein the inorganic phosphor has a size of about 1 μm to about 10 μm, and the quantum dot has a size of about 1 μm to about 10 nm.

25. The element as set forth in claim 1, wherein the inorganic phosphor is selected from the group consisting of $La_2O_2S$:Eu, $Li_2Mg(MoO_4)$:Eu,Sm, $(Ba,Sr)_2SiO_4$:Eu, ZnS:Cu,Al, $SrGa_2S_4$:Eu, $Sr_5(PO_4)_3Cl$:Eu, $(SrMg)_5PO_4Cl$:Eu, $BaMg_2Al_{16}O_{27}$:Eu, and mixtures thereof.

26. The element as set forth in claim 1, wherein the quantum dot is selected from the group consisting of group II-VI compound semiconductor nanocrystals, including CdS, CdSe, CdTe, ZnS, ZnSe, ZnTe, HgS, HgSe and HgTe, group III-V compound semiconductor nanocrystals, including GaN, GaP, GaAs, InP and InAs, and mixtures thereof.

27. An electronic device, comprising an electroluminescent element, the electroluminescent element comprising:

a glass template, which includes a silica matrix and a plurality of pores, electrodes on opposing sides of the glass template, and a luminescent material in the plurality of pores, wherein the luminescent material comprises an inorganic phosphor and a quantum dot.

28. The electronic device as set forth in claim 27, wherein the electronic device is selected from the group consisting of display devices, illumination devices and backlight units.

* * * * *